US011178902B2

(12) United States Patent
Monzoni et al.

(10) Patent No.: US 11,178,902 B2
(45) Date of Patent: Nov. 23, 2021

(54) APPARATUS AND METHOD TO FETCH AN END PORTION OF A SHEET OF MATERIAL WOUND IN A BOBBIN

(71) Applicant: PHILIP MORRIS PRODUCTS S.A., Neuchatel (CH)

(72) Inventors: Alberto Monzoni, Bologna (IT); Stefano Malossi, Bologna (IT)

(73) Assignee: Philip Morris Products S.A., Neuchatel (CH)

( * ) Notice: Subject to any disclaimer, the term of this patent is extended or adjusted under 35 U.S.C. 154(b) by 174 days.

(21) Appl. No.: 16/613,157

(22) PCT Filed: May 18, 2018

(86) PCT No.: PCT/EP2018/063195
§ 371 (c)(1),
(2) Date: Nov. 13, 2019

(87) PCT Pub. No.: WO2018/211108
PCT Pub. Date: Nov. 22, 2018

(65) Prior Publication Data

US 2020/0187552 A1 Jun. 18, 2020

(30) Foreign Application Priority Data

May 19, 2017 (EP) ..... 17172081

(51) Int. Cl.
*A24C 5/20* (2006.01)
*A24C 5/39* (2006.01)

(52) U.S. Cl.
CPC ..... *A24C 5/20* (2013.01); *A24C 5/399* (2013.01); *B65H 2801/54* (2013.01)

(58) Field of Classification Search
CPC ..... A24C 5/20; A24C 5/399; B65H 2801/54
See application file for complete search history.

(56) References Cited

U.S. PATENT DOCUMENTS 3,800,807 A * 4/1974 Hays ..... A24B 5/14 131/324
4,212,145 A * 7/1980 Middleton ..... A01D 45/16 56/27.5

(Continued)

FOREIGN PATENT DOCUMENTS

FR 2486507 1/1982
JP S6475118 3/1989

OTHER PUBLICATIONS

International Search Report and Written Opinion for PCT/EP2018/063195 dated Jun. 26, 2018 (11 pages).

*Primary Examiner* — Michael H. Wilson
*Assistant Examiner* — Stephanie Lynn Moore
(74) *Attorney, Agent, or Firm* — Mueting Raasch Group

(57) ABSTRACT

The invention relates to an apparatus (100) and a method to fetch an end portion of a sheet (40) of material wound in a bobbin (152), the apparatus including: a rotatable bobbin holder (150) adapted to be inserted in a bobbin; an articulated arm (180); a suction device (110) having a contact surface (124) including a first portion (130) capable of exerting a first suction power and a second portion (132) capable of exerting a second suction power different from zero, wherein the first suction power is higher than the second suction power, the suction device being attached to the articulated arm; and a control unit (190), adapted to command a movement of the articulated arm so that the first portion of the contact surface of the suction device contacts the bobbin. The invention also relates to a method to fetch an end portion of a sheet of material wound in a bobbin.

15 Claims, 5 Drawing Sheets

(56) References Cited

U.S. PATENT DOCUMENTS

| | | | | | |
|---|---|---|---|---|---|
| 4,278,489 | A | | 7/1981 | Horsley | |
| 4,347,856 | A | * | 9/1982 | Woltman | A24C 1/28 131/105 |
| 4,744,711 | A | * | 5/1988 | Heitmann | A24C 5/20 242/560 |
| 5,902,431 | A | * | 5/1999 | Wilkinson | B65H 39/16 156/159 |
| 2002/0189746 | A1 | | 12/2002 | Kuta | |
| 2005/0076929 | A1 | * | 4/2005 | Fitzgerald | A24D 1/02 131/365 |

* cited by examiner

APPARATUS AND METHOD TO FETCH AN END PORTION OF A SHEET OF MATERIAL WOUND IN A BOBBIN

This application is a U.S. National Stage Application of International Application No. PCT/EP2018/063195 filed May 18, 2018, which was published in English on Nov. 22, 2018 as International Publication No. WO 2018/211108 A1. International Application No. PCT/EP2018/063195 claims priority to European Application No. 17172081.6 filed May 19, 2017.

This invention relates to an apparatus and a method to fetch an end portion of a sheet of material wound in a bobbin. In particular, the invention relates to an apparatus and a method to fetch an end portion of a sheet-like tobacco material for use in an aerosol-generating article such as, for example, a cigarette or a "heat-not-burn" type tobacco containing product.

In the manufacture of tobacco products, besides tobacco leaves, also homogenized tobacco material may be used. This homogenized tobacco material is typically manufactured from parts of the tobacco plant that are less suited for the production of cut filler, like, for example, tobacco stems or tobacco dust. Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder are mixed to form a slurry. The slurry is then used to create a tobacco web, for example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. A process for making such homogenized tobacco is for example disclosed in European Patent EP 0565360, for instance.

During manufacturing process of aerosol-generating articles, such as smoking articles, at least one component comprises a material, usually in a sheet or foil format, may go through a crimping process. The crimped material is then compressed into a continuous rod which is cut into parts, usually tubular, called "sticks" or "rods". These rods are components of the aerosol-generating articles. The crimping process uses two rotating cylindrical rollers between which the sheet of material is pressed. These rollers have matching textured ridge-and-trough patterns on their outside surfaces that crimp the sheet.

For storage and transport, the sheet of material may be provided wound up in a bobbin and fed subsequently to the crimping rollers. The sheet of material may be fragile as well as sticky, which often is the case for sheets of so called Tobacco-Cast-Leaf (TCL) material, Poly-Lactic-Acid (PLA) material and others. Because of the sticky and fragile properties of the sheet of material, this material, when wound up in bobbins, may be difficult to unwind properly. During manufacturing of aerosol-generating articles, bobbins may be unwound at a high speed so that the sheet of material coming from the bobbin can be fed at high speed to the crimping rollers.

The handling of such bobbins, and specifically the changing of bobbins, implies at one stage to grab the loose end part of a new bobbin and connect it to a specific part of the manufacturing machine which can then make a splice with the foil coming from the previous bobbin.

There is therefore a need for an apparatus and a method to securely fetch an end portion of a sheet of material in an automated process wherein the sheet of material is wound up in a bobbin.

According to a first aspect, the invention relates to an apparatus to fetch an end portion of a sheet of material wound in a bobbin, the apparatus including a rotatable bobbin holder adapted to be inserted in a bobbin; an articulated arm; a suction device having a contact surface including a first portion capable of exerting a first suction power and a second portion capable of exerting a second suction power different from zero, wherein the first suction power is higher than the second suction power, the suction device being attached to the articulated arm; and a control unit, adapted to command a movement of the articulated arm so that the first portion of the contact surface of the suction device contacts the bobbin.

Advantageously, the apparatus allows a handling of bobbins, and specifically the changing of bobbins, where the suction device is able to automatically grab the loose end part of a new bobbin and preferably also connect it to a specific part of the manufacturing machine. Preferably, the apparatus can then make a splice with the sheet of material coming from a previous bobbin which may then be cut and removed. Due to the possible fragility of the sheet of material, a "strong" suction power is used only when needed, that is, when there is the need to detach the free end of the bobbin from the remaining of the bobbin. Afterwards, a lower sucking power is used. Further, according to the invention, thanks to the presence of the articulate arm which can move the suction device, the free end of the bobbin can be located substantially in any angular position.

As used herein, the term "sheet" denotes a laminar element having a width and length substantially greater than the thickness thereof.

As used herein, the term "longitudinal direction" refers to a direction extending along, or parallel to, the length of a sheet or web.

As used herein, the terms "axial" or "axially" refer to a direction extending along, or parallel to, the cylindrical axis of a rod.

As used herein, the term "rod" denotes a generally cylindrical element of substantially circular or oval cross-section.

As used herein, the term "homogenised tobacco material" denotes material formed by agglomerating particulate tobacco.

A homogenised tobacco material may be in the form of a sheet. The homogenised tobacco material may have an aerosol-former content of greater than about 5 percent on a dry weight basis. The homogenised tobacco material may alternatively have an aerosol former content of between about 5 percent and about 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and nonaqueous solvents and combinations thereof.

The homogenized tobacco material may form part or the entirety of an aerosol-forming substrate. An aerosol-forming substrate may be a solid aerosol-forming substrate. Alternatively, the aerosol-forming substrate may comprise both solid and liquid components. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a plug, the entire plug including any wrapper is considered to be the aerosol-forming substrate.

As used herein, aerosol forming article is any article that generates an inhalable aerosol when an aerosol forming substrate is heated. The term includes articles that comprise an aerosol forming substrate that is heated by and external heat source, such as an electric heating element. An aerosol forming article may be a non-combustible aerosol forming article, which is an article that releases volatile compounds without the combustion of the aerosol-forming substrate. An aerosol forming article may be a heated aerosol forming article, which is an aerosol forming article comprising an aerosol forming substrate that is intended to be heated rather than combusted in order to release volatile compounds that can form an aerosol. The term includes articles that comprise an aerosol forming substrate and an integral heat source, for example a combustible heat source.

An aerosol-generating article may be a heated aerosol-generating article, which is an aerosol-generating article comprising an aerosol-forming substrate that is intended to be heated rather than combusted in order to release volatile compounds that can form an aerosol. A heated aerosol-generating article may comprise an on-board heating means forming part of the aerosol-generating article, or may be configured to interact with an external heater forming part of a separate aerosol-generating device. An aerosol-generating article may resemble a combustible smoking article, such as a cigarette. An aerosol-generating article may comprise tobacco. An aerosol-generating article may be disposable. An aerosol-generating article may alternatively be partially-reusable and comprise a replenishable or replaceable aerosol-forming substrate.

The aerosol-generating article may be substantially cylindrical in shape. The aerosol-generating article may be substantially elongate. The aerosol-generating article may have a length and a circumference substantially perpendicular to the length. The aerosol-forming substrate may be substantially cylindrical in shape. The aerosol-forming substrate may be substantially elongate. The aerosol-forming substrate may also have a length and a circumference substantially perpendicular to the length. The aerosol-forming substrate may be received in the aerosol-generating device such that the length of the aerosol-forming substrate is substantially parallel to the airflow direction in the aerosol-generating device. The aerosol-cooling element may be substantially elongate.

The apparatus of the invention is used to automatically fetch and transport the loose end of a sheet of material wound up in a bobbin. Preferably, the material of the sheet is a material including alkaloids. More preferably, the sheet includes a plant material containing alkaloids. Even more preferably, the sheet includes tobacco, for example in the form if homogenized tobacco material.

A "material containing alkaloids" is a material which contains one or more alkaloids. Among alkaloids, nicotine is a preferred one, which can be found in tobacco.

Alkaloids are a group of naturally occurring chemical compounds that mostly contain basic nitrogen atoms. This group also includes some related compounds with neutral and even weakly acidic properties. Some synthetic compounds of similar structure are also termed alkaloids. In addition to carbon, hydrogen and nitrogen, alkaloids may also contain oxygen, sulfur and, more rarely, other elements such as chlorine, bromine, and phosphorus.

Alkaloids are produced by a large variety of organisms including bacteria, fungi, plants, and animals. They can be purified from crude extracts of these organisms by acid-base extraction. Caffeine, nicotine, theobromine, atropine, tubocurarine are examples of alkaloids.

A homogenized tobacco sheet is an alkaloid containing sheet. The alkaloids containing sheet can be therefore used as an aerosol-forming substrate.

Alkaloid containing materials, such as homogenized tobacco materials, may be formed by mixing several ingredients with water to obtain a slurry. In a further step, a continuous web of homogenized material is created on a support by casting the slurry onto the support. The cast sheet is then preferably dried and then wound in bobbins.

The bobbin of the sheet of material is placed into a bobbin holder. Generally, preferably bobbin holder and bobbin are coaxial. The bobbin holder is preferably rotatable around an axis.

The bobbin can have any shape and it is preferably cylindrical. Preferably, the bobbin defines an outer surface and a free end portion, which represents the end of the bobbin.

Further, in order to automatically detach the free end portion of the sheet wound in the bobbin, free end portion which may be then spliced together with another end portion of a different bobbin, the apparatus of the invention includes a suction device. The suction device is adapted to suck the free end portion of the bobbin in order to detach the same from the bobbin. To do so, the suction device includes a contact surface, adapted to contact a portion of the bobbin.

In order to obtain the contact, the suction device including the contact surface is moved by means of an articulated arm. More than one articulated arm may be present, for example forming a four bars linkage mechanism. Thanks to the provision of the articulate arm, the contact surface can reach substantially any position on the outer surface of the bobbin.

The articulated arm of the apparatus allows the suction device to reach a plurality of positions with respect to the bobbin. In particular, the position of the suction device can be continuously adapted. Favorably, a distance between the contact surface of the suction device facing the bobbin and the bobbin and/or an angle between the outer surface of the suction device facing the bobbin and the circumferential surface of the bobbin can be adjusted. Preferably, the contact surface of the suction device facing the bobbin can be oriented tangentially to the surface of the bobbin. The suction device can automatically contact and grab the end of the sheet of material with the outer surface of its first portion with a higher suction power while the second portion can be used to drag the sheet of material away from the bobbin.

A movement of the articulate arm is preferably controlled by a control unit. Control unit may also control the rotational speed of the bobbin or other devices of the apparatus.

The contact surface includes a first and a second portion. The first portion is apt to exert a first sucking power and the second portion is apt to exert a second sucking power, both first and second sucking powers being different from zero.

Preferably, the suction device can be adapted according to the material that will be treated. The suction device may be provided with air permeable holes. For a fragile sheet of material, the holes may be bigger than for a stronger sheet of material, as the suction power is related to the surface of the holes. For instance, a large hole will create the same suction power as a smaller hole having one third of the diameter but distributed on a surface which is nine times larger.

Preferably, the first portion of the suction device is positioned closer to the bobbin than the second portion of the suction device, when the end portion of the sheet of material needs to be fetched. The contact surface of the first portion of the first suction device contacts the bobbin at the outer surface of the bobbin, in particular the loose end of the sheet of material at the outer surface of the bobbin. The first portion fetches the loose end with a high first suction power. The second portion serves to separate the sheet of material from the bobbin when unwinding it from the bobbin. For separating the sheet of material from the bobbin, a lower suction power is sufficient compared to the first suction power.

Preferably, the distance and the angle of the contact surface of the suction device can be dynamically adjusted depending on the changing diameter of the bobbin during unwinding the sheet of material from the bobbin. It is of advantage if the contact surfaces of the first and the second portion of the suction device are in line with each other so that the outer surfaces of the first and second portion constitute an even outer surface of the suction device which is provided to contact the sheet of material.

Due to the fragility of certain sheets, as soon as the end portion is detached from the bobbin, a second—lower—sucking power is used. Therefore, preferably, the free end portion enters into contact first with the first portion of the contact surface, and then with the second portion, so that the sucking power decreases and the risk to damage the sheet of material may be minimized.

Preferably, the apparatus includes a diameter sensor, adapted to determine a diameter of the bobbin, the diameter sensor being electrically connected to the control unit so as to send to the control unit signals relative to the diameter of the bobbin. Preferably, the apparatus according to the invention, in particular the control unit of the apparatus, receives and uses information related to a current diameter of the bobbin. Preferably, the information is received in real time. The current diameter of the bobbin allows positioning the suction device in relation with the outer surface of the bobbin correctly. Such information is usually captured using an optical sensor pointing toward the bobbin.

Preferably, the apparatus includes an angular speed sensor, adapted to determine an angular speed of the bobbin holder, the angular speed sensor being electrically connected to the control unit so as to send to the control unit signals relative to the angular speed of the bobbin holder. Preferably, the apparatus according to the invention, in particular the control unit of the apparatus, receives and uses information related to a current angular speed of the rotatable bobbin holder. In particular the information is received in real time. Information about the angular speed of the rotatable bobbin holder and the current diameter of the bobbin can be used to move the suction device at the same speed as the outgoing sheet of material. Thus, the sheet of material can be efficiently dragged. The angular speed of the rotatable bobbin holder and the current diameter of the bobbin allow to evaluate the speed of the outgoing sheet of material, which is the angular speed multiplied with the circumference of the bobbin. It is possible to provide information to the apparatus about the speed of the dragging crimping rollers downstream of the suction device. Thus, a desired manufacturing speed of the sheet of material can be provided.

This allows for an automatic and preferably continuous positioning of the contact surface of suction device which is connected to the sheet of material with respect to the distance from the bobbin and/or the angle of the contact surface of the suction device compared to the contact surface of the bobbin. By distributing the suction power according to a required level locally on the sheet of material an overall desired suction effect can be created while at the same time preventing damaging the sheet of material. Moreover, once the suction device has fetched and separated the loose end of the sheet of material from the bobbin, less suction power is needed to hold the sheet of material and transport it to the distal end of the suction device towards further machine parts such as a crimping stage or the like. In the crimping stage the sheet of material is provided with corrugations on one or both sides. The corrugations in the sheet of material facilitate gathering the sheet of material and preparing rods of aerosol-generating articles.

Preferably, a width of the contact surface of the suction device at the first portion is wider than a width of the contact surface of the suction device at the second portion. The suction device may have different widths of the first and second portions for providing different suction powers in the portions. Preferably, the width of the first portion may be larger than the width of the second portion. Suction power may be generated with holes in conveyor belts. Preferably, the suction power can be controlled by a number of holes and/or size of holes and/or area containing the holes. The apparatus may comprise a cylindrical element with the cylinder axis parallel to the sheet of material and to the outer surface of the suction device. This cylindrical element can be moved, for instance using a rail, a chain, a drive or the like, along the transport direction of the suction device. The sheet of material is moved between the cylindrical element and the suction device. By moving the cylindrical element toward the bobbin it is possible to redirect a dragging force applied to the sheet of material by the suction device so the force is acting practically in radial direction of the bobbin, helping to unstuck the sheet of material from the bobbin and so helping to unwind the sheet of material from the bobbin.

Advantageously, the apparatus includes a guiding means positioned substantially parallel to the contact surface of the suction device and overlapping a part of the second portion, adapted to guide an end portion of the sheet of material between the surface of the suction device and the guiding means. The sheet of material can easily glide on the guiding means. Preferably, the guiding means may have a flat external surface. More preferably, the external surface may be arranged parallel to the contact surface of the suction device, in particular with the contact surface of the suction device intended to cooperate with the sheet of material. Preferably, the guiding means is arranged at the distal end of the suction device with respect to the position of the bobbin which is opposite to the location of the first portion of the suction device intended to fetch the sheet of material from the bobbin. Preferably, the guiding means has a specific tip shape at the side where the incoming sheet of material arrives. This tip may be rounded or angled at the end pointing towards the sheet of material. The tip may by planar on the opposing side towards the bobbin, so that the rounded/angled side provides for gently pulling the sheet of material from the bobbin without presenting an acute angle that could cut the sheet of material. The planar side of the tip pointing towards the bobbin on the other hand allows the round side to approach, if needed, as close as possible to the bobbin so that the sheet of material is separated with a slight and increasing angle in an early stage of separation from the bobbin.

Advantageously, the apparatus includes a presence sensor positioned at the surface of the suction device, adapted to determine the presence of a sheet portion on the surface of the suction device. The presence sensor allows for deciding whether a portion of the sheet of material is in contact with the suction device or not. Thus, the function of the suction device can be securely controlled. In a preferred embodiment, the presence sensor is an optical sensor, for instance, the presence sensor may be a laser emitting diode coupled with a photosensitive sensor. The presence sensor may be oriented towards an area where the sheet of material should be positioned when correctly fetched. In case the sheet of material is indeed in the correct position, the light of the laser will reflect on the sheet of material and will be detected by the photosensitive sensor. In such embodiment the optical sensor is positioned so as to point on the sheet of material when the foil is passing between the central conveyor belt and the skate shaped part. To avoid an erroneous detection of a reflection of the laser beam by the guiding means that could be misinterpreted as the presence of the sheet of material even when the sheet of material is not in the intended position, there is a hole in the guiding means in regard to the optical sensor. By this configuration, in case the sheet of material is not in position, the light emitted by the laser will go through the hole and will not be reflected by the guiding means.

Advantageously, the suction device includes a conveyor belt. A conveyor belt is easily to be controlled. Suction power can be provided via holes in the conveyor belt. The amount of suction power may be influenced by the number of holes per unit area and/or the size of the holes and/or the size of the area of the conveyor belt.

Preferably, the suction device includes three conveyor belts, positioned one adjacent to the others, so as to define a central conveyor belt and two lateral conveyor belts, the central conveyor belt being longer than the lateral conveyor belts, the first portion of the surface of the suction device including a surface portion of the central conveyor belt and of the two lateral conveyor belts and the second portion of the contact surface of the suction device including a surface portion of the central conveyor belt only. The difference in width of the first and second portion is given by the number of conveyor belts forming the first or the second portion. Favorably, the conveyor belts are driven by a common drive unit. This allows for a synchronous movement and easy control of the movement of the conveyor belts.

Advantageously, the contact surface of the suction device is movable. The movable contact surface can easily move the sheet of material in a gentle and controlled way.

The position of the suction device can be adjusted in relation to the bobbin. For instance, the position of the suction device can be adjusted in relation to the current diameter of the bobbin.

Advantageously, the apparatus includes a speed sensor adapted to determine a speed of the contact surface. The angular speed of the bobbin holder and the transport speed of the suction device, in particular the transport speed of the conveyor belts, can be synchronized. Stress and damage of the sheet of material can be avoided.

Preferably, the control unit is adapted to regulate a speed of the surface of the suction device depending on the angular speed of the bobbin holder. In particular, the transport speed of the conveyor belts of the suction device can be regulated to match the angular speed of the bobbin holder. Stress to the sheet of material can be reduced when the sheet of material is fetched by the suction device and pulled away from the bobbin. Damage to the sheet of material can be reduced when the bobbin is unwound.

Advantageously, the articulated arm of the apparatus includes two points of articulation. In a preferred embodiment, one point of articulation is in the same axis as the rotatable bobbin holder. Thus, the articulated arm is movable around the same axis as the rotatable bobbin holder. The articulated arm links the bobbin holder and the exit end of the suction device which is arranged distal to the bobbin. The articulated arm may be driven by a motor.

The other point of articulation has an axis close to the axis of the rotatable bobbin holder. The articulated arm is rotatable around the axis close to the axis of the rotatable bobbin holder. A connecting part is provided from the end of this rotatable part to an area roughly in the middle of the suction device. Such structure, using just two motorized rotatable parts the angles of which can be adjusted independently from one another, allows the accurate positioning of the suction device so that the outer surface of the suction device, for instance the surface of the conveyor belt in contact with the sheet of material coming out of the bobbin, could move toward the bobbin while keeping the same tangential angle reported to the bobbin.

Preferably, the apparatus includes a sensor to detect the position of the portion of the sheet of material wound in a bobbin placed on the bobbin holder. Such a sensor is preferably a proximity sensor. The sensor is used to maneuver in the proper position the suction device in order to detach the end portion of the bobbin from the bobbin.

According to a second aspect of the invention, a method to fetch an end portion of a sheet of material wound in a bobbin is proposed, the method including contacting with a suction device an external surface of a bobbin; sucking with a first suction power the contacted surface of the sheet so as to detach a sheet portion from the bobbin; and after detachment of the sheet from the bobbin, sucking with a second suction power the sheet portion which has been sucked with a first suction power, wherein the second suction power is lower than the first suction power.

The advantages of the inventive apparatus are already described with reference to the first aspect of the invention and are not repeated herewith.

The method allows for an automatic fetching of a loose end of a sheet of material wound up in a bobbin and supplying the sheet of material to a further processing of the sheet of material, such as a crimp process, at high speeds. The sheet of material is preferably a sheet of an aerosol generating material, such as tobacco and the like.

Advantageously, contacting with a suction device an external surface of the bobbin includes contacting the external surface tangentially to the external surface. This allows fetching the sheet of material gently even if the sheet of material is sticky and fragile. Bending the sheet of material at the interface between bobbin and suction device can be avoided. The sheet of material is prevented from damage.

Advantageously, the method includes guiding the detached sheet portion within a passage formed in the suction device. Preferably, for guiding the detached sheet portion, a guiding means is positioned substantially parallel to the contact surface of the suction device and overlaps a part of the second portion. The guiding means is adapted to guide an end portion of the sheet of material between the surface of the suction device and the guiding means. The sheet of material can easily glide on the guiding means. Preferably, the guiding means may have a flat external surface. More preferably, the external surface may be arranged parallel to the contact surface of the suction device, in particular with the contact surface of the suction device intended to cooperate with the sheet of material. Preferably, the guiding means is arranged at the distal end of the suction device with respect to the position of the bobbin which is opposite to the location of the first portion of the suction device intended to fetch the sheet of material from the bobbin. Preferably, the guiding means has a specific tip shape at the side where the incoming sheet of material arrives.

Advantageously, the method includes detecting whether a portion of the sheet has been detached from the bobbin. For detecting whether a portion of the sheet has been detached from the bobbin, the apparatus preferably includes a presence sensor positioned at the surface of the suction device. The presence sensor is adapted to determine the presence of a sheet portion on the surface of the suction device. The presence sensor allows for deciding whether a portion of the sheet of material is in contact with the suction device or not. Thus, the function of the suction device can be securely controlled. In a preferred embodiment the presence sensor is an optical sensor, for instance, the presence sensor may be a laser emitting diode coupled with a photosensitive sensor.

The invention will be further described, by way of example only, with reference to the accompanying drawings in which.

Figure 1:
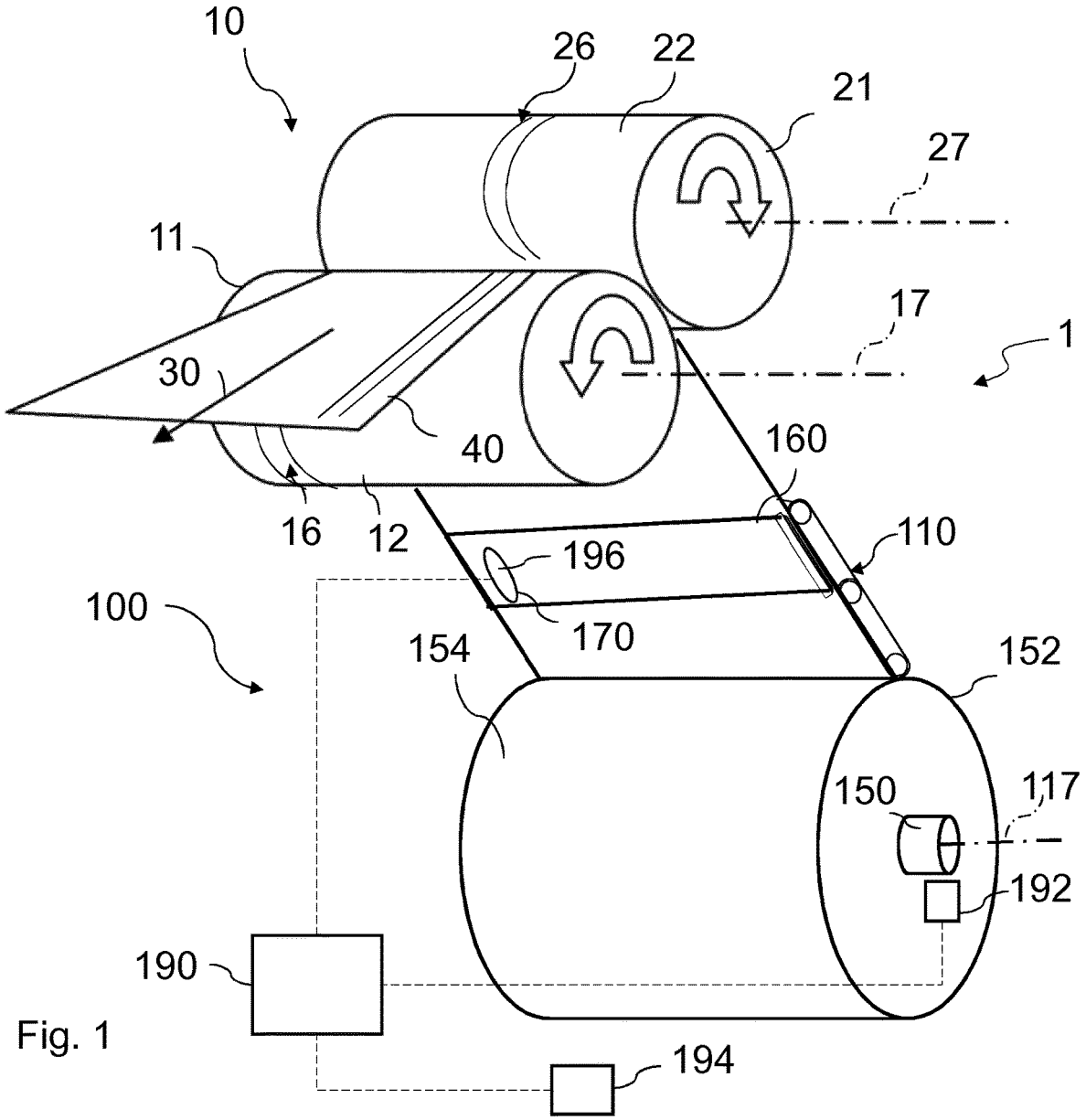
FIG. 1 shows in a simplified way an isometric view of a part of a manufacturing machine comprising an apparatus according to the invention, the apparatus being configured to fetch a loose end of a sheet of material upstream of a crimp stage encompassing two rollers between which the sheet of material is to be treated.

With initial reference to FIG. 1, the figure shows in a simplified way an isometric view of a part of a manufacturing machine 1 for manufacturing of aerosol-generating articles, using material 40 that is in sheet format delivered in bobbins 152. Such material could be for instance TCL (Tobacco Cast Leaf), comprising dried tobacco leaves which are cut in foils which are wound up into bobbins 152 for storage and transport. The material such as TCL may be both sticky and fragile which makes handling of the material difficult to unwind. Each bobbin 152 defines an outer or external surface 154 and a loose end (not visible) of the sheet of material 40 wound in the bobbin.

The manufacturing machine 1 comprises an apparatus 100 according to the invention, the apparatus 100 being configured to fetch a loose end of the sheet of material 40 which is wound up in the bobbin 152. For fetching the loose end of the sheet 40 the apparatus 100 comprises a suction device 110 which is described in detail in the following figures.

As an example, the bobbin 152 is arranged upstream of a crimp stage 10 of the manufacturing machine 1. During the manufacturing process, a specific machine unwinds these bobbins 152, one at a time, so as to use the sheet of material 40 for instance to create part of the aerosol-generating articles. The sheet of material unwound from the bobbin is used in the crimp stage 10.

The crimp stage 10 includes two crimping rollers 11, 21 between which the sheet of material 40 is to be treated. The transport direction 30 of the sheet 40 is indicated with an arrow pointing to left forward in the figure.

The first and second facing crimping roller 11, 21 define a first and second rotation axis 17, 27, respectively. The surfaces 12, 22 of the rollers 11, 21 are provided with ridge- and trough pattern 16, 26, which are indicated in a simplified manner by two circumferential lines on the surface of each roller 11, 21. The ridge- and trough pattern 16, 26 of the rollers 11, 21 generate corrugations in the sheet of material 40 when the sheet of material 40 is moved in transport direction 30 between the two crimp rollers 11, 21 of the crimp stage 10.

Figure 5:
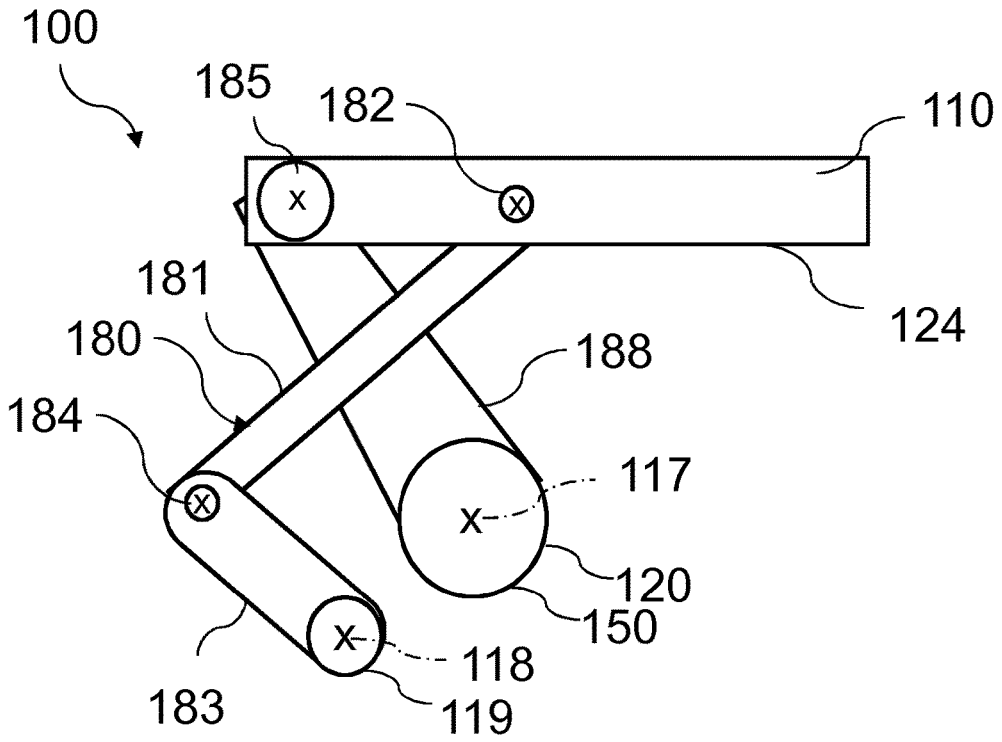
FIG. 5 shows a schematic side view of an embodiment of the apparatus according to the invention with the suction device in a first position.
Figure 6:
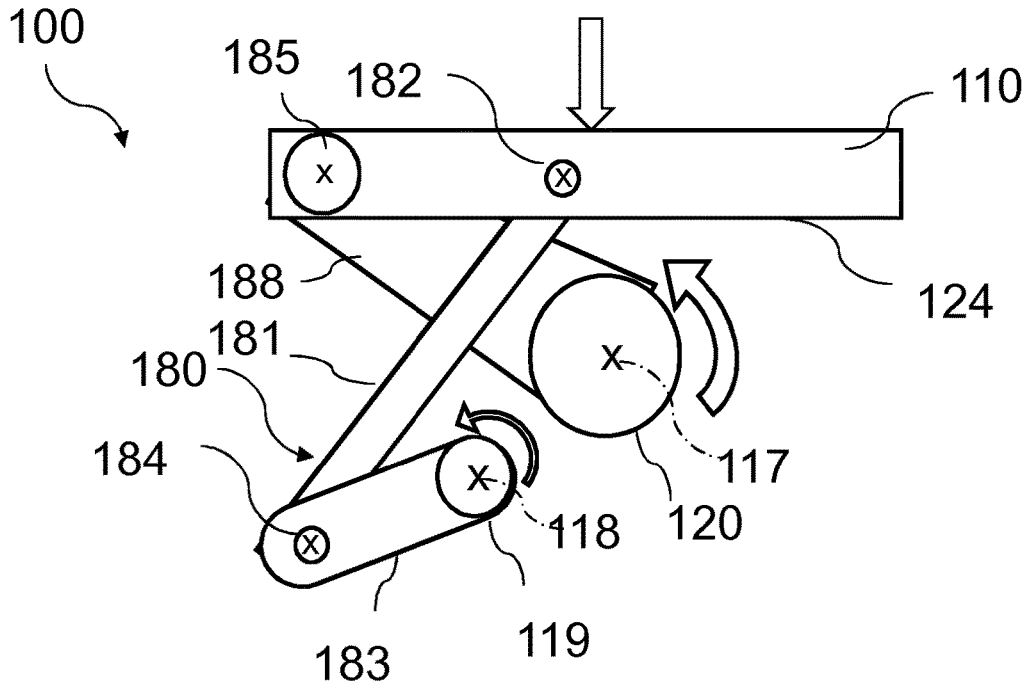
FIG. 6 shows a schematic side view of an embodiment of the apparatus according to the invention with the suction device in a second position.

The apparatus 100 for unwinding the bobbin 152 comprises a rotatable bobbin holder 150 and the suction device 110 arranged at an articulated arm (visible in FIGS. 5-6). The articulated arm is provided for adapting the position of the suction device 110 with respect to the external surface 154 of the bobbin 152. The rotatable bobbin holder 150 is adapted to be inserted in the bobbin 152. The bobbin holder 150 then rotates and unwinds the bobbin while the sheet of material 40 coming from the bobbin 152 is dragged by specific rollers of the crimp stage 10. During manufacturing, the bobbin is unwound at a high speed so that the sheet of material 40 coming from the bobbin 152 can be processed with speeds usually between about 200 and about 400 meters per minute.

The apparatus 100 further comprises a speed sensor 192, a diameter sensor 194 and a presence sensor 196.

The speed sensor 192 is coupled to the rotatable bobbin holder 150 and adapted to determine an angular speed of the bobbin holder 150. The angular speed of the rotatable bobbin holder 150 can be synchronized with a required transport speed of the sheet of material 40.

The diameter sensor 194 is arranged close to the bobbin 152 and adapted to determine a diameter of the bobbin 152. The diameter of the bobbin 152 helps to know, for instance, when the bobbin 152 is close to be depleted and has to be replaced. Further, the suction device 110 can be positioned depending on a current diameter of the bobbin 152.

A presence sensor 196 is positioned at a contact surface 124 of the suction device 110, better detailed below and not visible in FIG. 1, and adapted to determine the presence of a sheet portion on the contact surface of the suction device 110. The presence sensor 196 determines if the sheet of material 40 is correctly dragged by the suction device 110. Preferably, the presence sensor 196 is an optical sensor. For instance, the optical sensor may comprise a laser emitting diode coupled with a photosensitive sensor, and is pointing where the sheet of material 40 should be positioned when correctly fetched by the suction device 110. In case the sheet of material 40 is indeed in the correct position, the sheet of material 40 will reflect the light of the laser which will be captured by the photosensitive sensor. In such embodiment the optical sensor is positioned so as to point on the sheet of material 40 when the sheet of material 40 is passing a specific portion of the suction device 110.

Preferably, the specific portion is in an area of a guiding means 160 of the suction device 110 (also not visible in FIG. 1 and better detailed below), where the sheet of material 40, when correctly positioned, will pass between the guiding means 160 and a contact surface of the suction device 110. To avoid catching a reflection of the laser from other parts that could be misinterpreted as the presence of the sheet of material 40 even when the sheet of material 40 is not present, there is an opening in the guiding means 160 in regard to the optical sensor. Thus, in case the sheet of material 40 is not in position, the light emitted by the laser will go through the opening and will not be reflected by the guiding means. The speed sensor 192, the diameter sensor 194 and the presence sensor 196 are electrically connected to a control unit 190 so as to send to the control unit 190 signals relative to the angular speed of the rotatable bobbin holder 150, the diameter of the bobbin 152 and the presence of sheet portion of the sheet of material 40 coming from the bobbin 152, respectively.

The control unit 190 is adapted to command a movement of the articulated arm (not shown in this figure). The control unit 190 is adapted to regulate a speed of the surface of the suction device 110 depending on the angular speed of the bobbin holder 152.

The handling of the bobbin 152, and specifically the mounting of a new bobbin 152, implies at one stage to fetch the loose end part of the sheet of material 40 of the new bobbin 152 and connect it to a specific part of the manufacturing machine which can then make a splice with the sheet of material coming from the previous bobbin which may then be cut and removed from the manufacturing machine. Favourably, the inventive apparatus 100 allows for a safe fetching of the loose end part of the sheet of material 40 of the new bobbin 152.

Figure 2:
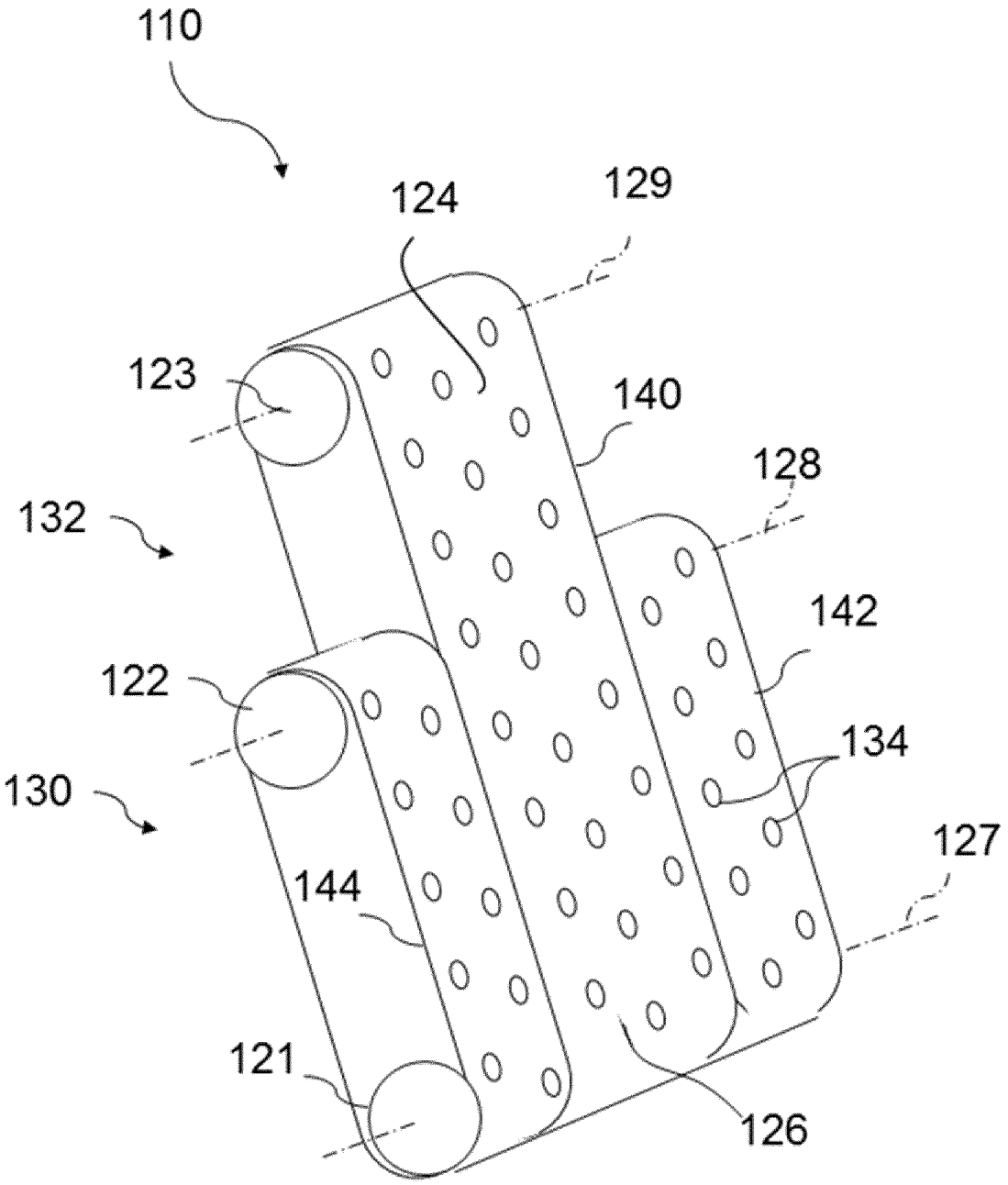
FIG. 2 shows a suction device of the apparatus in FIG. 1 according to the invention.

FIG. 2 shows an embodiment of the suction device 110 of the apparatus 100 in FIG. 1 according to the invention. The suction device 110 includes the contact surface 124 having a first portion 130 capable of exerting a first suction power and a second portion 132 capable of exerting a second suction power different from zero. The first suction power is higher than the second suction power. The suction device 110 is attached to an articulated arm (not shown in this figure). Preferably, the contact surface 124 of the section device 110 is movable. This allows moving the sheet of material in a transport direction when it is in contact with the suction device 110.

A width of the contact surface 124 of the suction device 110 at the first portion 130 is wider than a width of the surface 124 of the suction device 110 at the second portion 132.

The suction device 110 includes at least one conveyor belt. Preferably, the suction device 110 includes three conveyor belts 140, 142, 144, positioned one adjacent to the others, so as to define a central conveyor belt 140 and two lateral conveyor belts 142, 144. The central conveyor belt 140 is longer than the lateral conveyor belts 142, 144. The first portion of the surface 124 of the suction device 110 includes a surface portion of the central conveyor belt 140 and of the two lateral conveyor belts 142, 144 and the second portion 132 includes a surface portion of the central conveyor belt 140. Openings 134 (only two are labelled with a reference numeral as an example) in the conveyor belts 140, 142, 144. The suction device 110 comprises an air system (not shown) allowing the outside air to be sucked by the air system so that it can create a suction effect to an outside material in contact with the suction device 110.

The relative positioning of the conveyor belts 142, 144 is such that their surfaces that will be in contact with the sheet of material 40 are coplanar. Further, the conveyor belts 140, 142, 144 have a common end from which they extend. From this common end, the loose end of the bobbin 152 will be fetched by the suction device 110. In order to easily coordinate the speed of the conveyor belts 140, 142, 144, the conveyor belts 140, 142, 144 preferably share the same drive in their drive pulleys 121 with a common axis 127. Conveyor belts 140, 142, 144 may include additional pulleys 122, 123. The other pulleys 122, 123 may be idler pulleys with axes 128, 129.

Using multiple conveyor belts 140, 142, 144, in particular three conveyor belts 140, 142, 144, allows distributing the suction effect on a relatively large surface which will both create an overall strong suction strength while at the same time preventing damaging the sheet of material 40.

In this perspective, the size or diameter of openings 134 in the conveyor belts 140, 142, 144 may be adjusted according to the material that will be treated. For a fragile material, the openings 134 may be bigger than for a stronger material, as the pressure/suction is related to the surface of the openings 134. For instance, a large opening will create the same suction effect as smaller openings having a third of the diameter but distributed on a surface nine time larger.

Figure 3:
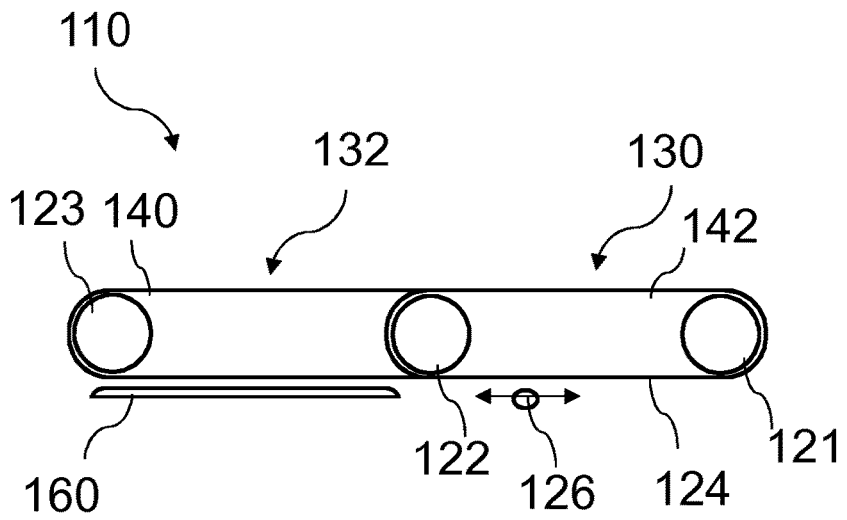
FIG. 3 shows a schematic side view of the suction device in FIG. 2.
Figure 4:
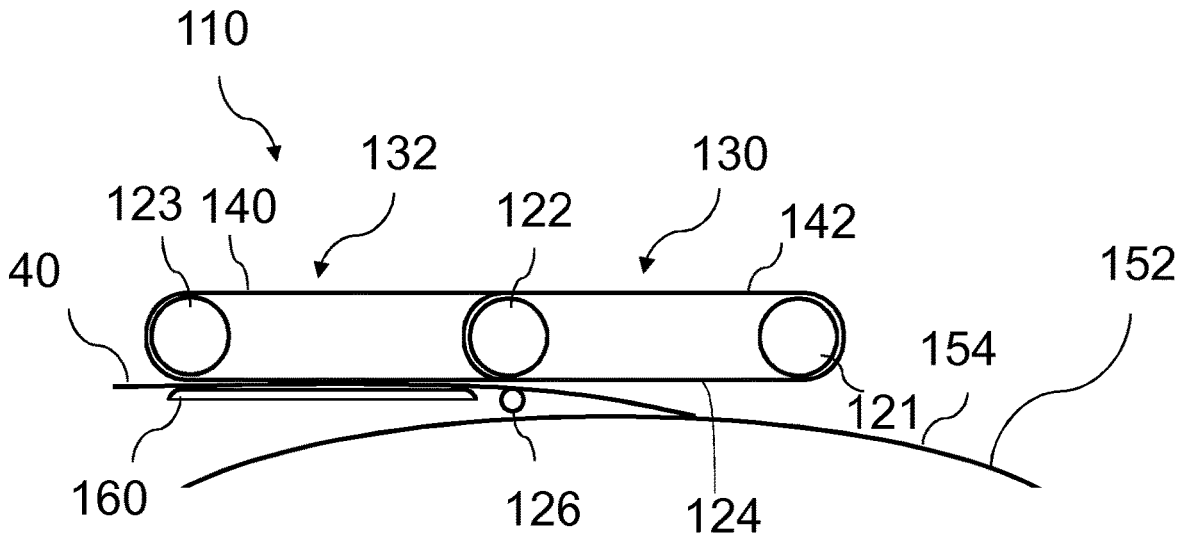
FIG. 4 shows a schematic side view of the suction device in FIG. 2 in contact with a detached portion of a sheet of material.

FIGS. 3 and 4 show schematic side views of the suction device 110 of FIG. 2, respectively without and with a portion of the sheet of material 40 being detached and pulled away from the bobbin 152.

In the lateral views, the contact surface 124 including the first portion 130 exerting the first suction power and the second portion 132 exerting the second suction power different from zero, are visible. The contact surface 124 of the suction device 110 faces the sheet of material 40 when a sheet of material 40 is present, as depicted in FIG. 4. Further, guiding means 60 are visible, which have been mentioned in connection to presence sensor 196.

The guiding means 160 is positioned substantially parallel to the contact surface 124 of the suction device 110 and overlaps a part of the second portion 132. The guiding means 160 is adapted to guide an end portion of the sheet of material 40 between the surface 124 of the suction device 110 and the guiding means 160. The guiding means 160 may have a skate-like shape. The guiding means 160 helps to separate the sheet of material from the bobbin 152 (FIG. 1) when unwinding it. The sheet of material can slide upon the guiding means 160.

The guiding means 160 has roughly a flat surface, with the plane of the surface parallel to the contact surface 124 of the conveyor belts. The guiding means 160 is located at the end of the suction device 110 which is opposite to where the suction device fetches the sheet of material 40 from the bobbin 152. The guiding means 160 has a specific tip shape where the incoming sheet of material 40 arrives. This tip is rounded (or angled) toward the sheet of material 40 and planar on the other side toward the bobbin 152, so that the round side helps gently pulling the sheet of material 40 from the bobbin 152 without presenting acute angle that could cut the sheet of material 40, while the flat part allows the round side to get, if needed, as close as possible to the bobbin 152 so the sheet of material 40 gets early separated with a slight and increasing angle.

When the suction device 110 makes contact with the sheet of material 40, the contact surface 124 of the suction device 110 is arranged tangentially to the external surface 154 of the bobbin 152 (see for example FIG. 4 where the sheet 40 is depicted).

Once the loose end of the sheet of material is grabbed, it has to be separated from the bobbin 152. This is done by the coordinate dragging action of the conveyor belts 140, 142, 144. The surfaces of the conveyor belts 140, 142, 144 are aligned so that they are tangentially positioned to the external surface 154 of the bobbin 152, and which are moving at the same speed as the external surface 154 of the bobbin 152. The conveyor belts 140, 142, 144 preferably work in a coordinated manner on this area of the sheet of material 40.

Once the loose end has been detached from the bobbin 152, less strength needs to be applied to hold the sheet of material 40 and to drag it up to the end of the suction device 110. Preferably, only one conveyor belt 140 is present in the second portion 132 of the suction device 110. However, to keep enough suction power when going from the first portion 130 of the suction device 110 in transport direction of the sheet of material 40, the width of the central conveyor belt 140 may be larger than the other conveyor belts 142, 144, for instance ⅓ larger and so having ⅓ more holes for air suction, than the two shorter conveyor belts 142, 144.

The indicated structure of three conveyor belts 140, 142, 144 separates the area of the suction device which is intended for making contact with the sheet of material 40 into two portions for the suction device 110, one portion with a strong suction power (the area with the three conveyor belts) and one with less suction power (the area with one conveyor belt 140), giving a lot of flexibility in the use of the suction device 110.

The apparatus 100 may also comprise a cylinder 126 (see FIG. 4) may be provided at the contact surface 124 of the suction device 110 with the cylinder axis perpendicular to the direction of the sheet of material 40 and parallel to the contact surface 124. This cylinder 126 can be moved, for instance using a rail, a chain and a drive, along the transport direction of the contact surface 124. The sheet of material 40 goes between the cylinder 126 and the contact surface 124 of the suction device 110. By moving the cylinder 126 toward the end of the suction device 110 close to the bobbin 152, it is possible to redirect the dragging force applied to the sheet of material 40 by the suction device 110 so that the force acts quite radial to the bobbin 152, helping to detach the sheet of material 40 from the bobbin 152 and, thus, supporting unwinding the bobbin 152.

FIGS. 5 and 6 show schematic side views of an embodiment of the apparatus 100 according to the invention with the suction device 110 in a first position and a second position, respectively.

The apparatus 100 further includes an articulated arm 180 and a rotatable arm 188 connected with the suction device 110 in order to move the same in substantially any position of the bobbin. The articulated arm 180 preferably has two points of articulation 182, 184, one roughly in the middle of the longitudinal elongation of the suction device 110, in particular of the central conveyor belt 140, and one between two arm segments 181, 183. The first arm segment 181 is attached to the suction device 110 and pivotable about the first point of articulation 182. The other arm segment 183 is a motorized component that is attached to a pivot joint 119 having a pivot axis 118 close to the rotatable bobbin holder 150 (FIG. 1).

The rotatable arm 188 is pivotable around the same axis 117 as the rotatable bobbin holder 150 (FIG. 1) and links the rotatable bobbin holder 150 (FIG. 1) and the distal end of the suction device 110. The rotatable arm 188 is connected to the suction device 110 at a pivot joint 185 arranged at the end of the suction device 110 which is distal from the bobbin 152 (FIG. 1).

Such structure, using just two motorized rotational parts the angles of which can be adjusted independently from one another, allows the accurate positioning of the suction device 110 so that the contact surface 124 of the suction device 110 in contact with the sheet of material 40 coming out of the bobbin 152 can move toward the bobbin 150 while keeping the same tangential angle with reference to the bobbin 152.

In FIG. 6 the suction device 110 has been moved downwards compared to the position in FIG. 5, which is indicated by a bold arrow in FIG. 6, by a movement of the articulated arm 180 and the rotatable arm 188. The rotatable arm 188 has the same axis 117 as the rotatable bobbin holder 150 and the articulated arm 180 has an axis 118 next to the rotatable bobbin holder 150, while conserving the same alignment of the contact surface 124 regarding to the rotatable bobbin holder 150.

According to the invention, it is possible to position the suction device 110 in regard to the bobbin 152 and to make it following in real time the external surface 154 of the bobbin 152 (see FIG. 1) while the bobbin 152 is unwound, keeping the same planar alignment. The suction device 110, once properly positioned, can fetch and drag the loose end of the bobbin 152.

The control unit 190 shown only in FIG. 1 is adapted to command a movement of the articulated arm 180 so that the first portion 130 of the contact surface 124 of the suction device 110 contacts the bobbin 152. The control unit 190 (FIG. 1) is adapted to regulate a speed of the surface 124 of the suction device 110 depending on the angular speed of the rotatable bobbin holder 150.

To work properly, the control unit 190 preferably receives in real time information about the current diameter of the bobbin 152, so as to be able to position correctly the suction device 110 regarding the external surface 154 of the bobbin 152, the angular speed of the rotatable bobbin holder 150 and current diameter of the bobbin 152 so as to move the contact surface 124 of the suction device 110 at the same speed than the outgoing sheet of material 40 so as to efficiently drag it. The angular speed of the rotatable bobbin holder 150 and the current diameter of the bobbin 152 allow evaluating the speed of the outgoing sheet of material 40 (the angular speed multiplied by the circumference of the bobbin 152).

An alternative way to do it is to adjust to the conveyor belts 140, 142, 144 the speed of the dragging rollers 11, 21 (FIG. 1) of the other part of the manufacturing machine, for instance the wished manufacturing speed of the sheet of material 40.

Figure 7:
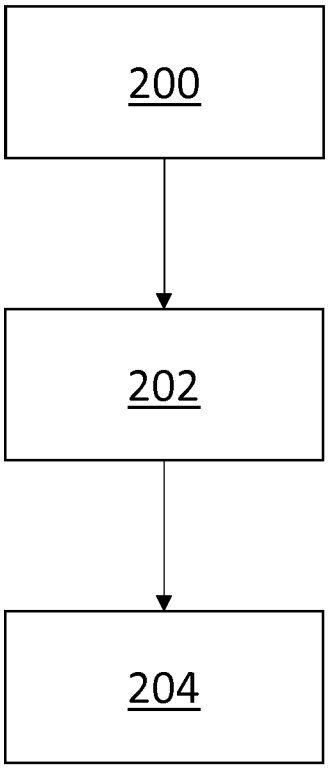
FIG. 7 shows a flowchart of the inventive method.

FIG. 7 illustrates a flowchart of the inventive method to fetch an end portion of the sheet of material 40 wound in the bobbin 152.

In step 200 the external surface 154 of the bobbin is contacted with the suction device 110. Step 200 may include contacting the external surface tangentially to the external surface.

In step 202 the contacted surface of the sheet is sucked towards the contact surface 124 of the suction device with a first suction power so as to detach a sheet portion from the bobbin.

After detachment of the sheet from the bobbin, in step 204 the sheet portion which has been sucked with a first suction power is sucked towards the contact surface 124 of the suction device with a second suction power, wherein the second suction power is lower than the first suction power. Optionally, step 204 may include guiding the detached sheet portion within a passage formed in the suction device. Further optionally, step 204 may include detecting whether a portion of the sheet has been detached from the bobbin.

The invention claimed is:

1. An apparatus to fetch an end portion of a sheet of material wound in a bobbin, the apparatus including:

a rotatable bobbin holder adapted to be inserted in a bobbin;

an articulated arm;

a suction device having a contact surface including a first portion capable of exerting a first suction power and a second portion capable of exerting a second suction power different from zero, wherein the first suction power is higher than the second suction power, the suction device being attached to the articulated arm; and a control unit, adapted to command a movement of the articulated arm so that the first portion of the contact surface of the suction device contacts the bobbin.

2. The apparatus according to claim 1, including a diameter sensor, adapted to determine a diameter of the bobbin, the diameter sensor being electrically connected to the control unit so as to send to the control unit signals relative to the diameter of the bobbin.

3. The apparatus according to claim 1, including an angular speed sensor, adapted to determine an angular speed of the bobbin holder, the angular speed sensor being electrically connected to the control unit so as to send to the control unit signals relative to the angular speed of the bobbin holder.

4. The apparatus according to claim 1, including a guiding means positioned substantially parallel to the contact surface of the suction device and overlapping a part of the second portion, adapted to guide an end portion of the sheet of material between the contact surface of the suction device and the guiding means.

5. The apparatus according to claim 1, including a presence sensor positioned at the contact surface of the suction device, adapted to determine the presence of a sheet portion on the contact surface of the suction device.

6. The apparatus according to claim 1, wherein the suction device includes a conveyor belt.

7. The apparatus according to claim 1, wherein a width of the contact surface of the suction device at the first portion is wider than a width of the contact surface of the suction device at the second portion.

8. The apparatus according to claim 6, wherein the suction device includes three conveyor belts, positioned one laterally adjacent to the others, so as to define a central conveyor belt and two lateral conveyor belts, the central conveyor belt being longer than the lateral conveyor belts, the first portion of the contact surface of the suction device including a surface portion of the central conveyor belt and of the two lateral conveyor belts and the second portion of the surface of the suction device including a surface portion of the central conveyor belt only.

9. The apparatus according to claim 1, wherein the contact surface of the suction device is movable.

10. The apparatus according to claim 1, including a speed sensor adapted to determine a speed of the contact surface.

11. The apparatus according to claim 9, wherein the control unit is adapted to regulate a speed of the contact surface of the suction device depending on the speed of the bobbin holder.

12. The apparatus according to claim 1, wherein the articulated arm includes two points of articulation.

13. A method to fetch an end portion of a sheet of material wound in a bobbin, the method including:

contacting with a suction device an external surface of a bobbin;

sucking with a first suction power the contacted surface of the sheet so as to detach a sheet portion from the bobbin; and after detachment of the sheet from the bobbin, sucking with a second suction power the sheet portion which has been sucked with a first suction power, wherein the second suction power is lower than the first suction power.

14. The method according to claim 13, wherein contacting with the suction device an external surface of the bobbin includes contacting the external surface tangentially to the external surface.

15. The method according to claim 13, including:

guiding the detached sheet portion within a passage formed in the suction device.

* * * * *